US005322459A

United States Patent [19]

Spinnato

[11] Patent Number: 5,322,459

[45] Date of Patent: Jun. 21, 1994

[54] FLEXIBLE SPRING ELECTRICAL CONTACT FOR AN ELECTRICAL CONNECTOR

[75] Inventor: Gilbert Spinnato, Guyancourt, France

[73] Assignee: Souriau et Cie., Versailles, France

[21] Appl. No.: 993,622

[22] Filed: Dec. 21, 1992

[30] Foreign Application Priority Data

Dec. 19, 1991 [FR] France ..... 91 15780

[51] Int. Cl.[5] ..... H01R 13/00

[52] U.S. Cl. ..... 439/843

[58] Field of Search ..... 439/843, 844, 851, 852, 439/853, 854, 856, 857, 861, 862

[56] References Cited

U.S. PATENT DOCUMENTS 4,572,606 2/1986 Neumann et al. ..... 439/843
4,614,029 9/1986 Neumann et al. ..... 439/843
4,621,422 11/1986 Neumann et al. ..... 439/843
4,693,002 9/1987 Neumann et al. ..... 439/843

FOREIGN PATENT DOCUMENTS 8205678 5/1960 Fed. Rep. of Germany .
3606340 12/1983 Fed. Rep. of Germany .
1247969 3/1987 France .

*Primary Examiner*—Joseph H. McGlynn
*Attorney, Agent, or Firm*—Pollock, Vande Sande & Priddy

[57] ABSTRACT

A female electrical contact including at least one axial elongate flexible spring offset from the axis (A) of the contact and elastically deformable in a transverse direction. The flexible spring (6) comprises a tail (5) engaged in a support (2, 4); a contact portion (7); an intermediate portion (8) located between the tail portion (5) and the front contact portion (7), and having longitudinal curvature of large radius without any folding so as to enable it to bend elastically in a transverse direction; and a portion (10) having a reduced moment of inertia located between the intermediate portion and the front contact portion, thereby making the spring suitable for distributing bending stresses over the entire length of the intermediate portion and facilitating progressive and continuous elastic bending thereof the three portions (5, 7, 8) and having predetermined transverse curvature imparting desired stiffness thereto; an abutment surface (2a) being located at the rear of the spring to keep its deformation within its elastic limits.

9 Claims, 3 Drawing Sheets

FLEXIBLE SPRING ELECTRICAL CONTACT FOR AN ELECTRICAL CONNECTOR

FIELD OF THE INVENTION

The present invention relates to female type contacts for an electrical connector, each contact having at least one elongate flexible spring extending substantially axially and spaced apart from the axis of the contact, the spring being elastically deformable in a transverse direction when an associated male type contact is inserted or extracted.

More particularly, but not exclusively, the invention relates to contacts for connectors that are intended for space applications, which contacts, given the special characteristics of to the space environment (vacuum, weightlessness, large temperature differences, impossibility of corrective maintenance), must satisfy requirements of high reliability, long useful like, and as great a reduction as possible in the forces required for insertion and extraction.

BACKGROUND OF THE INVENTION

Various "split-tube" contacts of the above-specified type are known in which the tube structure makes it difficult to control the insertion/extraction force, in particular because of excessive tolerance ranges. It is therefore necessary to sort contacts so as to eliminate those which are out-of-range.

In addition, presently manufactured flexible spring contacts do not provide a sufficient safety margin. This drawback is a direct result of the structure and the method of manufacture used for the flexible springs currently in use. The contact end of a spring is obtained by folding a metal part that was initially rectilinear in the longitudinal direction. When the contact end is subjected to radial resilient forces during insertion/extraction operations, it pivots relative to the fixing portion via a fold that acts as a hinge. As a result, stresses are concentrated and the metal is subjected to considerable stress at the fold, which means that its safety factor is insufficient for certain applications, such as space applications.

Furthermore, in a flexible spring contact organized in that way, only the contact end is displaceable and it alone determines the force bearing against the pin of the male contact with which it is required to co-operate (the bearing force being determined in particular by its length and its slope), thereby determining the insertion-/extraction force. The remainder of the spring is not involved in determining said force, and as a result, when considered overall, the spring is too rigid for it to be possible to obtain an insertion/extra ction force that is as small as could be desired for making it easy to operate connectors having a large or a very large number of contacts.

SUMMARY OF THE INVENTION

It is a particular object of the invention to remedy the above-described drawbacks of present flexible spring electrical contacts so as to enable them to be more satisfactory as regards reliability, useful life, and magnitude of insertion/extraction force, in particular for special applications such as use in the space environment.

To this end, the present invention provides a female type electrical contact for an electrical connector, the contact including at least one elongate flexible spring extending substantially axially with an offset from the axis of the contact, and being elastically deformable transversely, essentially characterized in that said flexible spring comprises:

a tail portion engaged in a support;

a front contact portion designed to bear against a male type contact when inserted in said female contact;

an intermediate portion situated between the tail portion and the front portion of the contact, which intermediate portion is curved longitudinally towards the axis of the contact with curvature of large radius and without any fold, and is suitable for bending elastically in the transverse direction when a male type contact is inserted; and a portion having a reduced moment of inertia situated between the intermediate portion and the front portion, thereby obtaining a reduction in resistance to bending suitable for distributing stresses over the entire length of the intermediate portion and encouraging continuous and progressive elastic bending of the intermediate portion when the flexible spring co-operates with a male type contact;

at least one of the intermediate portion, the portion having a reduced moment of inertia, and the front portion having a predetermined transverse curvature imparting desired stiffness thereto;

and the contact further comprises an abutment surface situated behind the flexible spring (relative to the axis of the contact) to limit transverse deformation of the spring and to keep it within its elastic deformation limits.

Advantageously, in a simple embodiment of the flexible spring, the portion having a reduced moment of inertia is narrower than the intermediate portion and the front portion on either side thereof. Still for the same purpose, the thickness of the flexible spring may be substantially constant throughout all of its portions; it is then possible, at least in some embodiments, for the flexible spring overall to be obtained from a sheet of metal.

Still for the purpose of simplifying manufacture of the spring-blade cutouts, it is advantageous for the transverse curvature of the flexible spring to be substantially constant, at least over the entire length of the intermediate portion, the portion having a reduced moment of inertia, and the front portion. This transverse curvature can then be obtained by a conventional technique of curving the spring already cut out in a sheet of metal.

When made in accordance with the invention, each spring is capable of being highly adapted to elastic deformation without there being a concentration of stress in any particular region, this being achieved by eliminating the fold that is present in the flexible spring of prior art contacts.

The elastic deformation limit can be extended by using beryllium-copper that is completely or partially treated to the core, and this remains possible within acceptable cost constraints with springs being produced from a cutout and curved thin strip of beryllium-copper regardless of which technological solution (individual springs or groups of springs) is adopted.

Because of these dispositions that spread stresses over the entire surface of the part avoiding the stress concentrations that are usually encountered, a remarkable safety factor of more than 2 is achieved, between the range of normal use and the limiting deformation where deformation becomes permanent.

By appropriate scaling, the same shape can be applied to a wide range of contact sizes.

In a preferred embodiment which should give satisfaction over a large number of applications, the contact further comprises:

an outer rigid tubular body inside which the above-mentioned flexible spring is received, the portion of the inside surface of the tubular body situated behind the flexible spring constituting the above-mentioned abutment surface; and an internal plug situated in the rear portion of the tubular body with the tail portion of the flexible spring being engaged between the plug and the tubular body.

In practice, the tubular body and the inside plug can be secured to each other by crimping, thereby clamping the tail portions of the springs between them.

Various structures associated with various manufacturing processes can be envisaged. Thus, in a first possible implementation, use is made of blade cutouts made in unitary form that have their tail portions engaged between the tubular body and the inside plug and the widths of their respective tail portions are such that they surround the inside plug and come into lateral abutment against one another. Alternatively, the flexible springs may be connected together at a single component part and their tail portions combined in the form of a tubular sleeve which is engaged between the tubular body and the inside plug. In either case, provision may be made for the tail portion to have at least one radial projection extending inwards and engaged in a housing in the inside plug so as to hold the spring axially.

BRIEF DESCRIPTION OF THE DRAWINGS

The invention will be better understood on reading the following detailed description of preferred embodiments given by way of purely illustrative examples. In this description, reference is accompanying drawings, in which.

DESCRIPTION OF PREFERRED EMBODIMENTS

Figure 1:
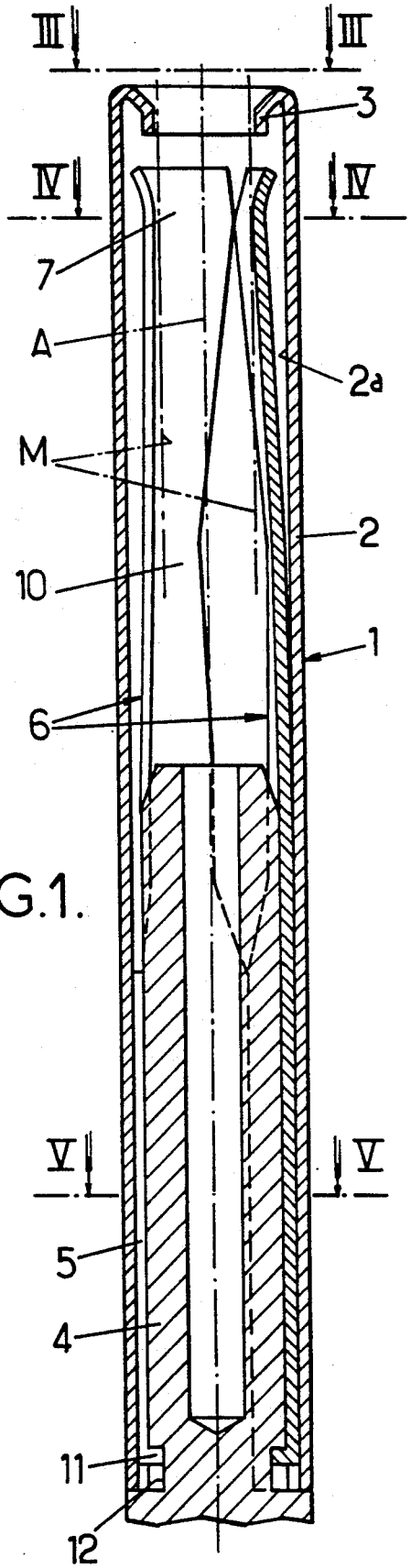
FIG. 1 is a diametral section through a contact having three flexible springs made in accordance with the invention.

With reference initially to FIGS. 1 to 5, the female type contact 1 comprises, for example, an outer tubular body or tube 2 which is open at both ends, one of its ends being designed to receive a male contact, e.g., of the pin type (whose lateral outline is represented schematically by chain-dotted lines referenced by the letter M), and having an edge that curves inwards to form a guiding lip 3.

At its rear end, the tube 2 receives a solid plug 4 whose own rear end is shaped in any appropriate manner (not shown) enabling it to be connected to an electric cable.

The tail portions 5 of a plurality (in this case three) flexible springs 6 that are uniformly spaced apart circumferentially are engaged between the outer tube 2 and the plug 4.

Figure 2:
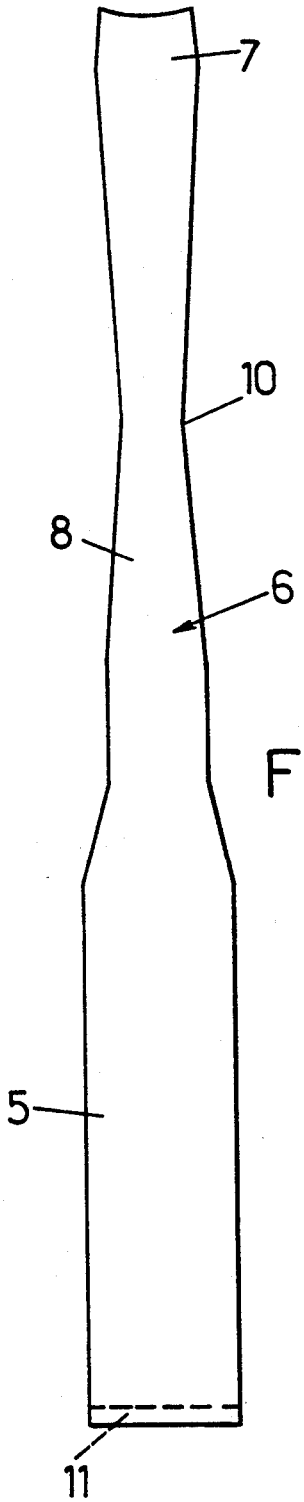
FIG. 2 is a plan view of a unitary flexible spring used in the contact of FIG. 1.

As can be seen better in FIG. 2, each spring 6 is in the form of an elongate metal spring blade made of beryllium-copper for example, and at least locally treated to its core. The spring has a front contact portion 7 and a rear tail portion 5 which are connected together by an intermediate portion 8 of continuous large-radius curvature towards the axis A of the contact and without folding.

In order to enable the spring to have sufficient stiffness given its relatively small thickness, it is curved transversely along its entire length. Its radius of transverse curvature is the same, at least over the entire length of above-mentioned portions 7 and 8.

In order to increase the longitudinal flexibility of the metal spring and to obtain stress distribution along the entire length of its intermediate portion 8, thereby making it highly suitable for elastic bending when subjected to transverse forces, a portion having a reduced moment of inertia is provided at 10 between the front portion of the contact 7 and its intermediate portion 8, this portion being achieved in this case by reducing the width of the metal spring. The region of reduced width 10 is disposed between the portions 7 and 8 that are of progressively increasing width.

Finally, when seen from above (FIG. 2) the flexible spring has an outline of varying width which, in combination with its transverse curvature, gives rise to a member of longitudinally varying stiffness and of controlled longitudinal flexibility.

Figure 3:
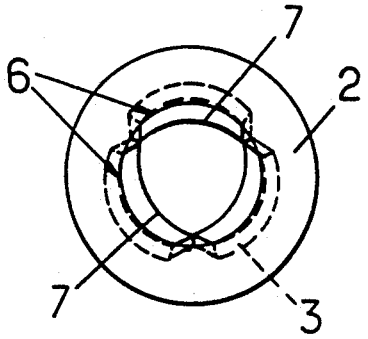
FIGS. 3 to 5 are cross-section views respectively on lines III—III, IV—IV, and V—V of FIG. 1.
Figure 4:
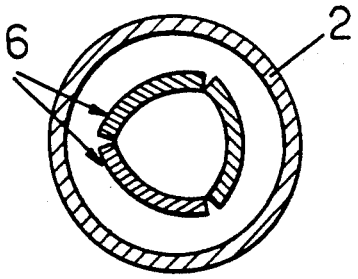
Figure 5:
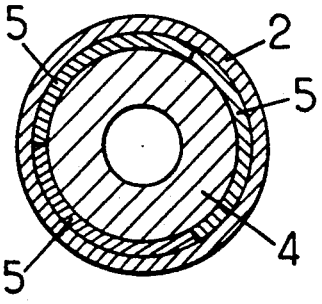

The cross-sections of the various portions of the contact 1 are shown in FIGS. 4 and 5, namely: in FIG. 4 the cross-section of the contact portion of the springs on line IV—IV of FIG. 1; in FIG. 5 the cross-section of the tail portion 5 of the springs on line V—V of FIG. 1; and finally, in FIG. 3, an end view of the contact 3 on line III—III of FIG. 1.

During a connection operation, inserting the pin M of a male contact in the female sleeve 1 causes the contact front portions 7 of the springs 6 to be raised transversely as shown in FIG. 1. The wall 2*a* of the tubular body 2 serves as an abutment limiting the transverse deflection of the spring 6.

The controlled deformation in the various areas of each spring makes it possible, while maintaining good-quality electrical contact with the male pin, to reduce the force with which the contact portion 7 bears against the pin, thereby reducing the wear of these members.

Above all, such a shape makes it possible to work with the metal well below its elastic deformation limit (e.g., in a deformation range corresponding approximately to half the value of such limit, i.e., with a safety factor of 2), and it is thus certain that the metal will never be caused to work in its plastic deformation region.

In addition, a flexible spring designed in this way can be made of a highly resilient material such as core-treated beryllium-copper, using a manufacturing process that is simpler than that required of unitary female contacts. In this case, as shown in FIG. 2, each spring is cut out as a single flat piece from a metal sheet, after which it is curved transversely and longitudinally. Thereafter it is core-treated overall The tail portions 5 of the springs 6 are of a width such that when installed in the tubular body, they contact one another laterally and jointly cover the plug 4 completely, as can be seen in FIG. 5. This ensures that the springs 6 are locked laterally in appropriate positions.

Furthermore, each spring 6 may have a radial projection 11 at or near the free end of its tail 5. The projection extends inwards and is engaged in a recess (e.g., an annular groove 12) formed in the plug 4. The springs 6 are thus retained axially.

Figure 6:
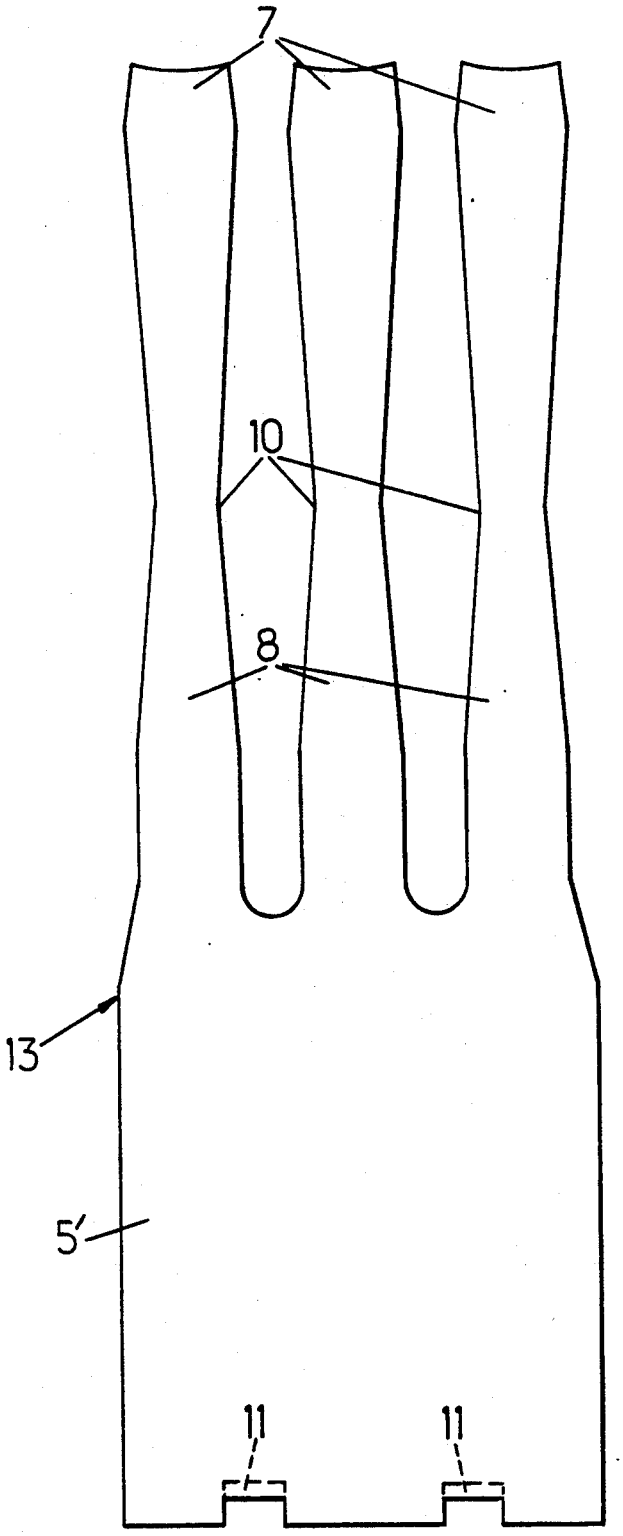
FIG. 6 is a plane view of a metal blank cut out to constitute the flexible springs of the FIG. 1 contact in grouped-together form.

FIG. 6 shows an embodiment in which the tail portions 5' are integral with one another and form a tubular sleeve which is fitted inside the outer tube 12, being engaged between the outer tube and the plug 4. All of the springs 6' and the tubular sleeve 5' are connected together, thus forming a single piece 13.

The piece 13 may be made in various different ways, e.g., by machining individual springs 6' in a length of tube, or more simply and more cheaply, by cutting out a metal blank as shown in FIG. 6 while flat and then in rolling it to form the transverse curvature of the springs 6' and of the sleeve 5'. Cutouts formed in the base of the metal blank enable the radial projections 11 for providing axial retention to be formed.

It will be understood that an electrical contact according to the invention can be made with an arbitrary number of flexible springs using ,the dispositions set forth above. The flexible springs are then angularly distributed in a uniform manner so that the male contact is guided axially by the springs or spring portions that face one another.

However, if the contact has only one flexible spring, certain special features need to be provided as described below with reference to FIGS. 7 to 10, for the purpose of ensuring proper guidance for the associated male contact.

Figure 7:
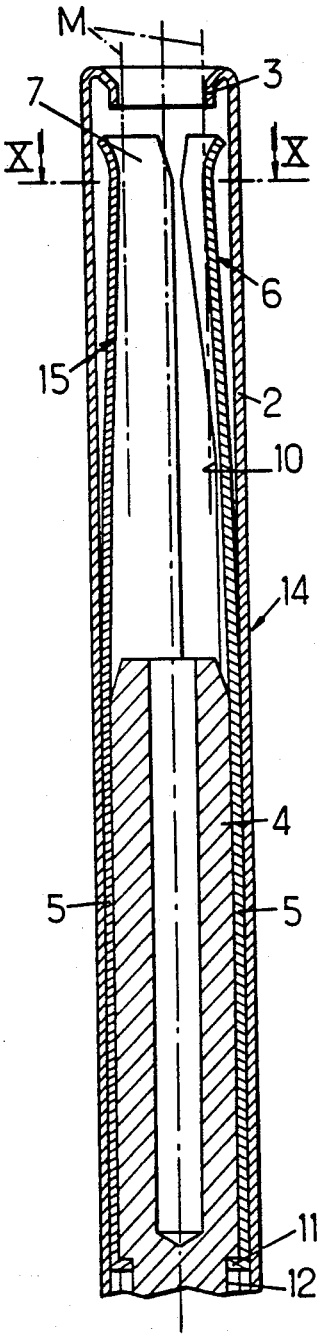
FIG. 7 is a diametral section through a single flexible spring contact made in accordance with the invention.

The contact 14 shown in FIG. 7 is made, in general, in the same way as the contact 1 of FIG. 1 (and the same numerical references are retained for designating items that are identical), that the contact 14 has only one flexible spring 6.

Figure 9:
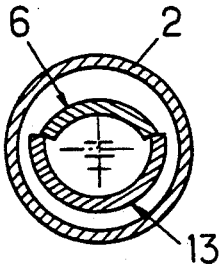
FIGS. 9 and 10 are cross-section views on line X—X of FIG. 7 showing the positions of the springs respectively with and without a male contact engaged in the FIG. 7 contact.
Figure 10:
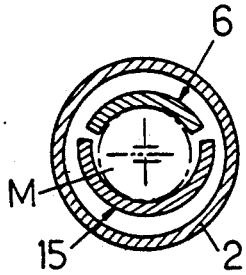

To compensate the transverse force exerted by the contact portion 7 on the associated male contact pin M to guide it during insertion/extraction, a guidance and thrust piece 15 is provided facing the flexible spring 6 and optionally shaped approximately like a contact spring, except insofar as it is not designed to flex transversely. The guidance and thrust piece 15 has a tail portion 5 designed to be engaged between the tubular body 2 and the plug 4 in the same manner as a flexible contact spring 6 or 6' as described above. It is curved transversely, but it does not have a region of reduced second moment of area. It may advantageously be wider than a flexible spring so as to facilitate guiding the male pin M, as can be seen clearly in FIG. 10 which shows the respective positions of the contact pieces 6 and 15 against a pin M engaged in the contact. FIG. 9 shows the same contact when the pin is absent.

Figure 8:
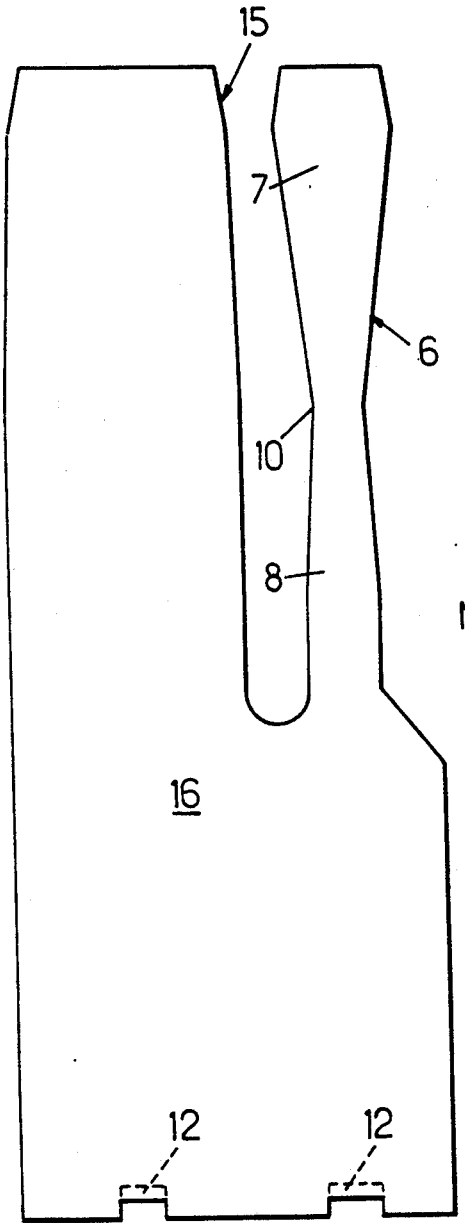
FIG. 8 is a face view of a metal blank cut out to constitute the flexible spring of the FIG. 7 contact.

The single flexible spring 6 and the guidance and thrust piece 15 may be constituted two by independent members in the manner described above, each being individually engaged and retained between the tube 2 and the plug 4, or alternatively they may be in the form of a one-piece member obtained by cutting out a metal blank 16 while flat, as shown in FIG. 8, and then rolling and curving such blank. The one-piece member 16 is then installed like the member 13 in FIG. 6.

I claim:

1. A female type electrical contact for an electrical connector, said contact including at least one elongate flexible spring extending substantially axially with an offset from an axis of said contact and being elastically deformable transversely, wherein said flexible spring (6, 6') comprises:

(a) a tail portion (5, 5') engaged in a support (2, 4);

(b) a front contact portion (7) bearing against a male type contact (M) when inserted in said female contact;

(c) an intermediate portion (8) located between said tail portion (5, 5') and said front contact portion (7) and being curved longitudinally towards said axis of the contact with a curvature of large radius and free of any fold, said intermediate portion being bent elastically in a traverse direction when a male type contact is inserted; and (d) a portion (10) having a reduced moment of inertia situated between said intermediate portion and said front contact portion, thereby obtaining a reduction in resistance to bending suitable for distributing stresses over an entire length of said intermediate portion and encouraging continuous and progressive elastic bending of said intermediate portion when said flexible spring cooperates with a male type contact;

(e) at least one of said intermediate portion, said portion of reduced moment of inertia, and said front contact portion having a predetermined transverse curvature imparting desired stiffness thereto; and said support comprising an interior abutment surface (2*a*) limiting transverse deformation of said flexible spring to keep it within elastic deformation limits of said spring.

2. A contact according to claim 1, wherein said portion (10) having a reduced moment of inertia is narrower than said intermediate portion and said front contact portion on either side thereof.

3. A contact according to claim 1, wherein said flexible spring has a substantially constant thickness throughout all portions of said flexible spring.

4. A contact according to claim 1, wherein said flexible spring has a substantially constant transverse curvature, at least over the entire length of said intermediate portion having a reduced moment of inertia, and said front contact portion.

5. A contact according to claim 1, wherein said support is an outer rigid tubular body (2) housing said flexible spring (6, 6'), said interior abutment surface (2*a*) of said tubular body constituting the above-mentioned abutment surface situated at the rear of said flexible spring, an internal plug (4) being located in a rear portion of said tubular body, the tail portion (5, 5') of said flexible spring being engaged between said plug and said tubular body.

6. A contact according to claim 5, including a plurality of distinct flexible springs (6) having tail portions of widths such that they surround said internal plug (4) while coming laterally into abutment against one another.

7. A contact according to claim 15, including at least two flexible springs (6') formed as a single piece (13), said springs having tail portions which form a tubular sleeve (5) surrounding said plug.

8. A contact according to claim 5, including a single flexible spring (6) and a guidance and thrust piece (150) for said male contact, said guidance and thrust piece facing said flexible spring.

9. A contact according to claim 5, wherein said tail portion (5, 5') has at least one radial projection (11) extending inwards and engaged in a housing (12) of said internal plug (4) for axial retention purposes.

* * * * *